US008948667B2

(12) United States Patent
Kim et al.

(10) Patent No.: US 8,948,667 B2
(45) Date of Patent: Feb. 3, 2015

(54) IMAGE FORMING APPARATUS AND AUTO COLOR REGISTRATION METHOD OF THE SAME

(75) Inventors: Dong-kyu Kim, Suwon-si (KR); Kwon-cheol Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 434 days.

(21) Appl. No.: 13/137,817

(22) Filed: Sep. 14, 2011

(65) Prior Publication Data

US 2012/0155894 A1 Jun. 21, 2012

(30) Foreign Application Priority Data

Dec. 20, 2010 (KR) ..... 10-2010-0130919

(51) Int. Cl.
*G03G 15/01* (2006.01)
*G03G 15/00* (2006.01)
*G03G 15/16* (2006.01)

(52) U.S. Cl.
CPC ..... *G03G 15/5058* (2013.01); *G03G 15/0131* (2013.01); *G03G 15/161* (2013.01); *G03G 15/5054* (2013.01); *G03G 2215/00059* (2013.01); *G03G 2215/0125* (2013.01); *G03G 2215/0161* (2013.01)
USPC ..... 399/301

(58) Field of Classification Search
CPC ..... G03G 15/5054; G03G 15/5058; G03G 2215/00059; G03G 2215/0161
USPC ..... 399/49, 72, 301; 347/116
See application file for complete search history.

(56) References Cited

U.S. PATENT DOCUMENTS

| | | | | |
|---|---|---|---|---|
| 5,291,245 | A * | 3/1994 | Charnitski et al. | |
| 5,784,676 | A | 7/1998 | Iseki et al. | |
| 6,493,533 | B1 * | 12/2002 | Munakata | 399/301 |
| 2003/0068180 | A1 * | 4/2003 | Kaji | 399/301 |
| 2004/0258437 | A1 * | 12/2004 | Kakutani et al. | 399/301 |
| 2006/0257177 | A1 * | 11/2006 | Kim et al. | 399/301 |

(Continued)

FOREIGN PATENT DOCUMENTS

JP 2002174992 A * 6/2002

OTHER PUBLICATIONS

European Search Report dated May 23, 2012 issued in corresponding European Patent Application 11181542.9.

(Continued)

*Primary Examiner* — Walter L Lindsay, Jr.
*Assistant Examiner* — Milton Gonzalez
(74) *Attorney, Agent, or Firm* — Staas & Halsey LLP

(57) ABSTRACT

An image forming apparatus and an auto color registration method of the same which prints a color image by single pass, the image forming apparatus including: a plurality of developing units which each develops a color image in a predetermined color; a transfer unit which transfers the color image developed by developing units to the print medium and include a transfer belt rotatably installed on a transfer path; a first detector provided in a predetermined location of the transfer belt to face the transfer belt and detects any defect from a surface of the transfer belt; a second detector provided in a predetermined location of the transfer belt to face the transfer belt and detects a test pattern of an auto color registration (ACR) error transferred to the transfer belt; and a controller which adjusts the ACR error based on data detected by the first detector and the second detector.

7 Claims, 7 Drawing Sheets

(56) References Cited

U.S. PATENT DOCUMENTS

| | | | | |
|---|---|---|---|---|
| 2007/0003332 | A1* | 1/2007 | Kim | 399/301 |
| 2008/0069603 | A1* | 3/2008 | Nakatsu | 399/301 |
| 2010/0178084 | A1 | 7/2010 | Kang et al. | |

OTHER PUBLICATIONS

European Search Report dated Apr. 22, 2013 in corresponding European Patent Application 11 181 542.9.

* cited by examiner

IMAGE FORMING APPARATUS AND AUTO COLOR REGISTRATION METHOD OF THE SAME

CROSS-REFERENCE TO RELATED APPLICATIONS

This application claims priority benefit from Korean Patent Application No. 10-2010-0130919, filed on Dec. 20, 2010 in the Korean Intellectual Property Office, the disclosure of which is incorporated herein by reference.

BACKGROUND

1. Field

Apparatuses and methods consistent with the exemplary embodiments relate to an image forming apparatus and an auto color registration method of the same, and more particularly, to an image forming apparatus and an auto color registration method of the same which prints a color image by single pass.

2. Description of the Related Art

In general, an electrophotographic image forming apparatus forms an electrostatic latent image on an image carrier charged by a predetermined electric potential, by exposing light thereto, develops the image with a developer in a predetermined color and transfers to a print medium and fuses the image. The electrophotographic image forming apparatus may be classified into a mono type and a color type according to a color realization. The color image forming apparatus may be classified further into a single pass type and a multi pass type according to a transfer method for images in each color.

The single-pass color image forming apparatus includes a plurality of developers corresponding to each color, e.g., developers corresponding to each of yellow (Y), magenta (M), cyan (C) and black (K) colors; and light scanning units corresponding to the developers to thereby overlap an image formed on the developers by single pass for realization of a color image. The realization of the color image requires an auto color registration (hereinafter, to be called the "ACR") which registers an image in each color developed by the developers, in a correct location.

As shown in FIG. 1, the single-pass color image forming apparatus forms an ACR pattern 11 in each of the colors Y, M, C and K on a transfer belt 10 by using a developer, and detects the ACR pattern 11 through an ACR detector 15 to thereby perform the ACR. The ACR pattern 11 in each color includes a first ACR pattern 11*a* and a second ACR pattern 11*b* inclined to the first ACR pattern 11*a* to identify any error in the ACR in a width direction of the transfer belt 10.

The ACR pattern 11 is provided in at least two locations in the width direction of the transfer belt 10. In such a case, the ACR detector 15 includes a plurality of detectors 15*a* and 15*b* to detect an error of the ACR with respect to the ACR pattern 11 provided in the width direction of the transfer belt 10.

If an ACR pattern is printed on the transfer belt 10 for the performance of the ACR, such ACR pattern may be distorted by a defect of a surface of the transfer belt 10. Then, the ACR detector 15 may detect the distorted ACR pattern, leading to a distortion of the ACR.

To prevent the foregoing problem, in the conventional image forming apparatus, the ACR detector 15 detects any error from the surface of the transfer belt 10 at idle when the ACR pattern is not printed thereon and reflects such detection result to printing the ACR pattern.

However, in the conventional image forming apparatus, when the transfer belt without the image printed thereto idles, a friction force between the transfer belt and a cleaning blade (not shown) cleaning a remaining developer from the transfer belt becomes higher and may turn over the cleaning blade. If a predetermined pattern is printed on the transfer belt at idle to prevent the turn-over of the cleaning blade, the surface of the transfer belt having the printed pattern thereon is not detected normally and the defect from the surface is not detected nor adjusted.

In the foregoing method, the transfer belt idles to detect the defect thereof and thus the ACR time increases as much as the idle time.

In another conventional method, an additional adjustment algorithm is used to adjust such defect based on ACR data without the process of detecting the defect from the surface of the transfer belt 10. In this case, accuracy of the adjustment deteriorates as the detection of the surface of the transfer belt 10 is not performed.

SUMMARY

Accordingly, one or more exemplary embodiments provide an image forming apparatus and an auto color registration method of the same which improves accuracy of adjustment by detecting a defect from a surface of a transfer belt through a physical detection process and detects such defect without idle the transfer belt.

The foregoing and/or other aspects may be achieved by providing an image forming apparatus which forms a color image on a print medium by overlapping an image formed in each color, the image forming apparatus including: a plurality of developing units which each develops a color image in a predetermined color; a transfer unit which transfers the color image developed by the plurality of developing units to the print medium and includes a transfer belt rotatably installed on a transfer path; a first detector which is provided in a predetermined location of the transfer belt to face the transfer belt and detects any defect from a surface of the transfer belt; a second detector which is provided in a predetermined location of the transfer belt to face the transfer belt and detects a test pattern of an auto color registration (ACR) error transferred to the transfer belt; and a controller which adjusts data on the test pattern of the ACR error formed in a defective location of the transfer belt detected by the first detector by using the defective location information, or causes the data on the test pattern of the ACR error formed in the defective location of the transfer belt detected by the first detector not to be reflected in an adjustment of the ACR error.

The transfer unit may further include a cleaning blade which is installed to face the transfer belt and cleans a developer remaining in the surface of the transfer belt.

The first detector may be arranged in a predetermined location between the cleaning blade and the plurality of developing units to face the transfer belt, and the second detector may be arranged in a predetermined location between the plurality of developing units and the cleaning blade to face the transfer belt, based on a rotation direction of the transfer belt.

A length from the first detector to the second detector of the transfer belt may be relatively longer than a length from the second detector to the first detector of the transfer belt, based on the rotation direction of the transfer belt.

The foregoing and/or other aspects may be achieved by providing an image forming apparatus which forms a color image on a print medium by overlapping an image formed in each color, the image forming apparatus including: a plurality of developing units which each develops a color image in a predetermined color; a transfer unit which transfers the color image developed by the plurality of developing units to the print medium and includes a transfer belt rotatably installed on a transfer path; a first detector which is provided in a predetermined location of the transfer belt to face the transfer belt and detects any defect from a surface of the transfer belt; a second detector which is provided in a predetermined location of the transfer belt to face the transfer belt and detects a test pattern of an auto color registration (ACR) error transferred to the transfer belt; and a controller which controls the developing units to form the test pattern of the ACR error by avoiding a defective location if the first detector detects the defect from the predetermined location of the transfer belt.

The transfer unit may further include a cleaning blade which is installed to face the transfer belt and cleans a developer remaining in the surface of the transfer belt.

The first detector may be arranged in a predetermined location between the cleaning blade and the plurality of developing units to face the transfer belt, and the second detector may be arranged in a predetermined location between the plurality of developing units and the cleaning blade to face the transfer belt, based on a rotation direction of the transfer belt.

A length from the first detector to the second detector of the transfer belt may be relatively longer than a length from the second detector to the first detector of the transfer belt, based on the rotation direction of the transfer belt.

The foregoing and/or other aspects may be achieved by providing an auto color registration (ACR) method of an image forming apparatus which forms a color image on a print medium by overlapping an image formed in each color, the ACR method including: detecting a defect from a surface of a transfer belt by a first detector; printing a test pattern of an ACR error on the transfer belt; detecting the test pattern of the ACR error formed on the transfer belt, by a second detector; determining whether there is any defect from the surface of the transfer belt; and adjusting data on the test pattern of the ACR error formed on a defective location of the transfer belt detected by the first detector by using the defective location information or controlling not to reflect the data on the test pattern of the ACR error formed in the defective location of the transfer belt detected by the first detector in an adjustment of the ACR error.

In the ACR method, the image forming apparatus may further include a cleaning blade to clean a developer remaining on the surface of the transfer belt, and the first detector may be arranged in a predetermined location between the cleaning blade and a plurality of developing units to face the transfer belt, and the second detector may be arranged in a predetermined location between the plurality of developing units and the cleaning blade to face the transfer belt, based on a rotation direction of the transfer belt.

In the ACR method, a length from the first detector to the second detector of the transfer belt may be relatively longer than a length from the second detector to the first detector of the transfer belt, based on the rotation direction of the transfer belt.

The foregoing and/or other aspects may be achieved by providing an auto color registration (ACR) method of an image forming apparatus which forms a color image on a print medium by overlapping an image formed in each color, the ACR method including: detecting a defect from a surface of a transfer belt, by a first detector; determining whether there is any defect from the surface of the transfer belt; printing a test pattern of an ACR error in a predetermined location of the transfer belt if there is no defect on the surface of the transfer belt and printing a test pattern of the ACR error on the transfer belt by avoiding a defective location of the surface if there is the defect on the transfer belt; detecting the test pattern of the ACR error formed on the transfer belt, by a second detector; and adjusting the ACR error result based on the detection result of the second detector.

In the ACR method, the image forming apparatus may further include a cleaning blade to clean a developer remaining on the surface of the transfer belt, and the first detector may be arranged in a predetermined location between the cleaning blade and a plurality of developing units to face the transfer belt, and the second detector may be arranged in a predetermined location between the plurality of developing units and the cleaning blade to face the transfer belt, based on a rotation direction of the transfer belt.

In the ACR method, a length from the first detector to the second detector of the transfer belt may be relatively longer than a length from the second detector to the first detector of the transfer belt, based on the rotation direction of the transfer belt.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
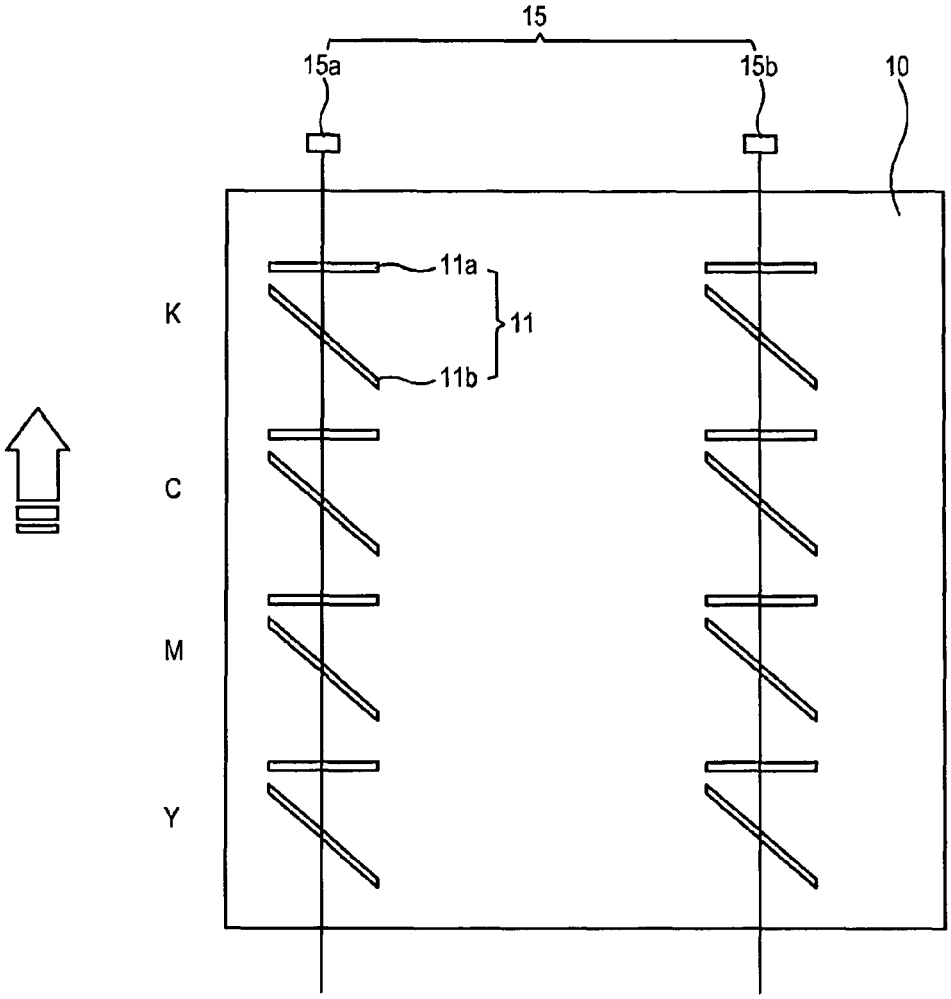
FIG. 1 (RELATED ART)
FIG. 1 illustrates a test pattern of an auto color registration (ACR) error formed on a surface of a transfer belt and an ACR detector of an image forming apparatus.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Figure 2:
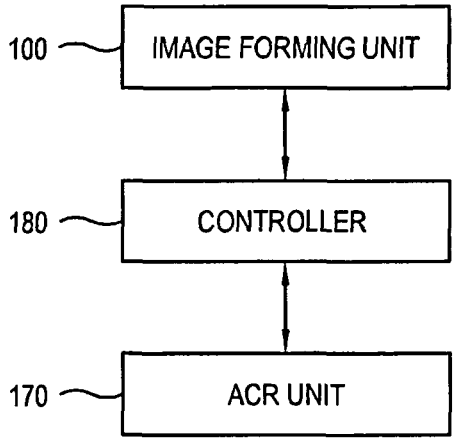
FIG. 2 is a block diagram of an image forming apparatus according to an exemplary embodiment.
Figure 3:
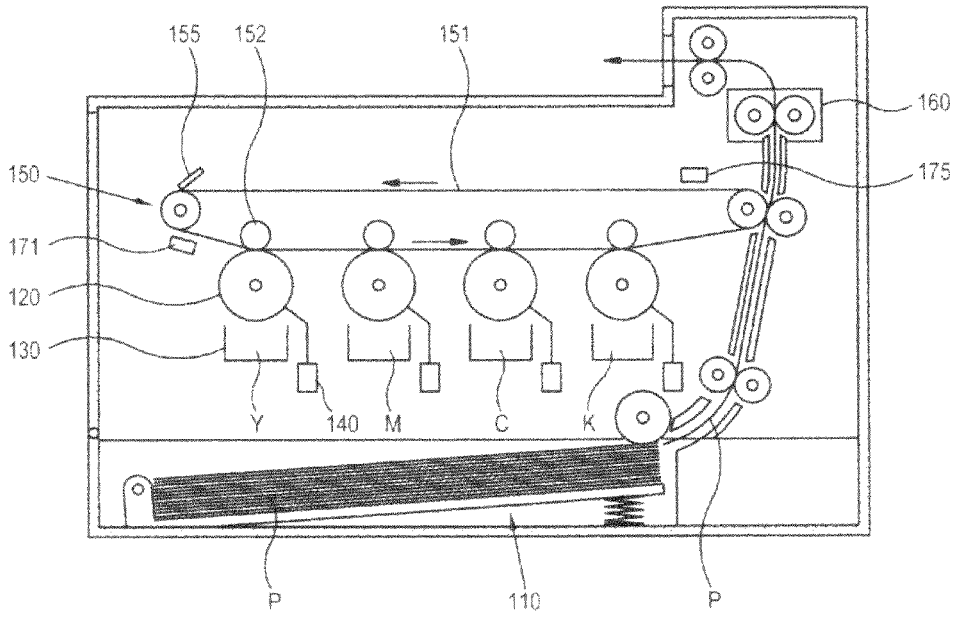
FIG. 3 illustrates an image forming apparatus according to a first exemplary embodiment.

FIG. 2 is a block diagram of an image forming apparatus according to an exemplary embodiment. FIG. 3 illustrates an image forming apparatus according to a first exemplary embodiment.

As shown therein, the image forming apparatus according to the exemplary embodiment includes an image forming unit 100 which independently forms and overlaps an image in each color to form a color image, an automatic color registration unit (hereinafter, to be called ACR unit) 170 which performs an ACR per color to form a color image and a controller 180 which controls the image forming unit 100 and the ACR unit 170.

The image forming unit 100 forms a color image on a print medium P fed by a medium feeder 110, and forms a test pattern of ACR errors per color (hereinafter, to be called "ACR pattern") on an image transfer path (e.g., a transfer belt 151 shown in FIG. 3) in proportion to the standard of the print medium.

The image forming unit 100 includes an image carrier 120, an exposing unit 140 which scans light to the image carrier 120 to form a latent image thereon, a developing unit 130 which develops a developer to the latent image formed on the image carrier 120 to form an image, a transfer unit 150 which transfers a developer image from the image carrier 120 to a print medium P, and a fusing unit 160 which fuses the image transferred to the print medium P by heat and pressure.

The developing unit 130 is arranged to face the image carrier 120 and develops a developer to an area where a latent image on the image carrier 120 is formed. The developing unit 130 and the image carrier 120 are provided for each color to thereby form a full color image by single pass. FIG. 3 illustrates four units to realize yellow (Y), magenta (M), cyan (C) and black (K) colors, respectively.

The exposing unit 140 scans light beam to form an electrostatic latent image on each of a plurality of image carriers 120.

The transfer unit 150 transfers to the print medium P a color image developed by the plurality of developing units 130. The transfer unit 150 includes a transfer belt 151 which faces the image carrier 120 and is rotatably installed on a transfer path, and a supporting roller 152 which rotatably supports the transfer belt 151.

The transfer unit 150 may transfer an image on the print medium P by an indirect transfer method. In this case, the transfer unit 150 primarily transfers the image developed on the image carrier 120 to the transfer belt 151, and then the transfer belt 151 rotates and transfers the image to the print medium P. The image transferred to the print medium P through the transfer unit 150 is fused by the fusing unit 160.

The transfer unit 150 of the image forming apparatus according to the exemplary embodiment may further include a cleaning blade 155. The cleaning blade 155 is installed to face the transfer belt 151, and cleans a developer remaining in a surface of the transfer belt 151 after the transfer of the image.

The single-pass color image forming apparatus may include a charger (not shown) which charges the image carrier 120 with a predetermined electric potential, a discharger (not shown) which removes an electric charge remaining in the image carrier 120, and a cleaning unit (not shown) which cleans dirt from the image carrier 120, which are provided in locations corresponding to the plurality of image carriers 120.

Figure 4:
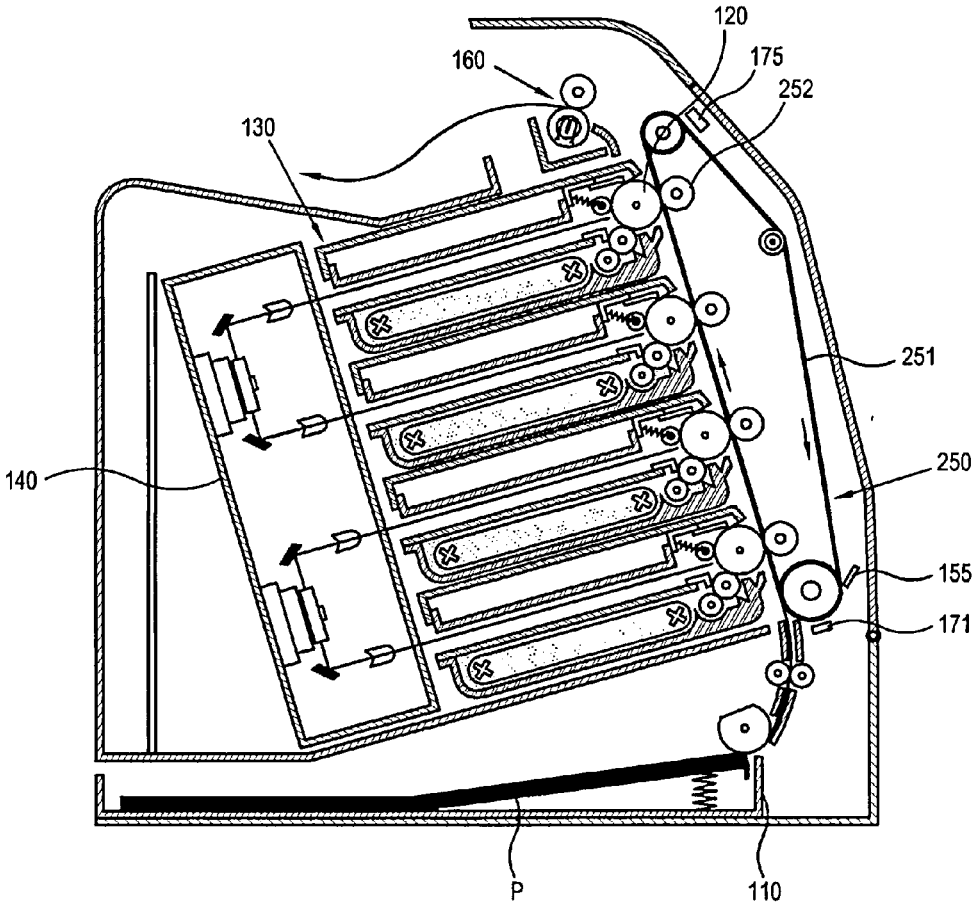
FIG. 4 illustrates an image forming apparatus according to a second exemplary embodiment.

FIG. 4 illustrates an image forming apparatus according to a second exemplary embodiment. Compared to the image forming apparatus according to the first exemplary embodiment, the image forming apparatus according to the second exemplary embodiment is substantially the same as that according to the first exemplary embodiment except it transfers an image by a direct transfer method. Thus, elements other than the transfer unit 250 are given the same names and numerals as those according to the first exemplary embodiment and the detailed description will be omitted.

Referring to FIG. 4, the transfer unit 250 transfers an image to the print medium P by a direct transfer method. Thus, the transfer unit 250 is provided to face the image carrier 120 leaving the print medium P moved along a moving path therebetween, and directly transfers a color image developed by the plurality of developing units 130 to the print medium P. The transfer unit 250 includes a transfer belt 251 rotatably installed on a transfer path, and a supporting roller 252 rotatably supporting the transfer belt 251.

As shown in FIGS. 3 and 4, the ACR unit 170 includes first and second detectors 171 and 175 which are installed around the transfer belts 151 and 251 to detect and adjust a defect from a predetermined location due to damage to a surface of the transfer belts 151 and 251 when the ACR process is performed.

The first detector 171 is provided in a predetermined location of the transfer belts 151 and 251 to face them, and detects a defect from the surface of the transfer belts 151 and 251. The first detector 171 is arranged in a predetermined location between the cleaning blade 155 and the plurality of developing units 130 to face the transfer belts 151 and 251, based on a rotation direction of the transfer belts 151 and 251. Accordingly, the first detector 171 may detect a defect from the surface of the transfer belts 151 and 251 which are cleaned by the cleaning blade 155 with respect to a developer remaining on the surface of the transfer belts 151 and 251.

The second detector 175 is provided in a predetermined location of the transfer belts 151 and 251 spaced from the first detector 171, and detects an ACR pattern transferred to the transfer belts 151 and 251. The ACR pattern is formed on the transfer belts 151 and 251 by the image forming unit 100 in an ACR mode, and may be formed on the surface of the transfer belts 151 and 251 in the shape as shown in FIG. 1.

The second detector 175 is provided in a predetermined location between the developing unit 130 and the cleaning blade 155 to face the transfer belts 151 and 251, and reads information on the ACR pattern transferred to the surface of the transfer belts 151 and 251 in the ACR mode.

Figure 5:
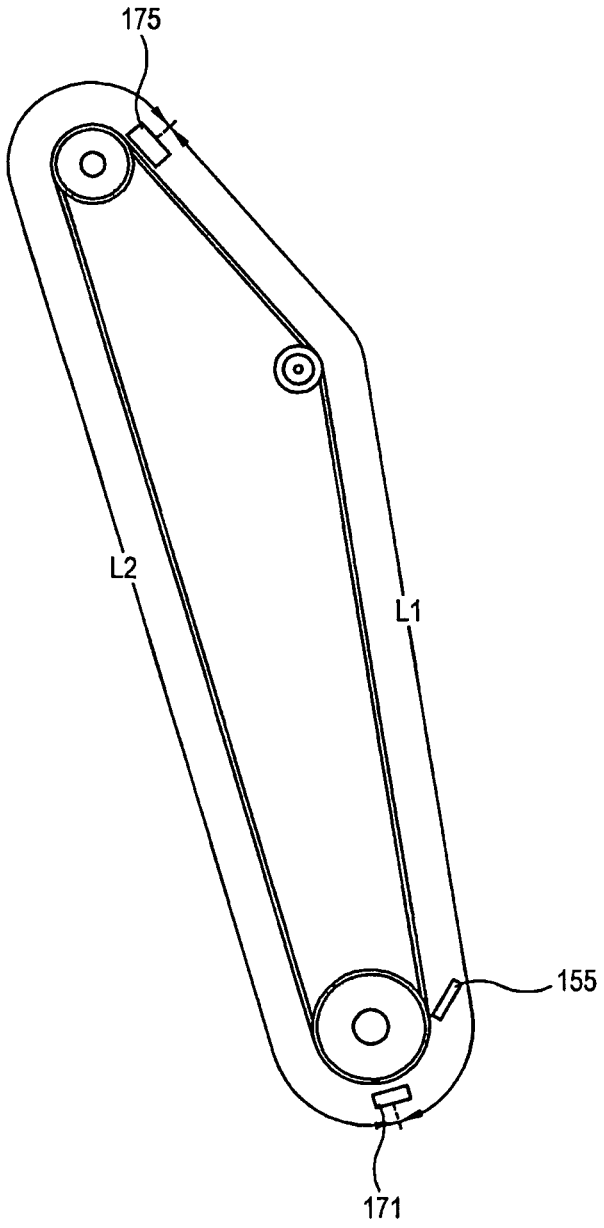
FIG. 5 illustrates major parts of the image forming apparatus in FIG. 4.

Based on the rotation direction of the transfer belts 151 and 251, a length L2 from the first detector 171 to the second detector 175 of the transfer belts 151 and 251 may be longer than a length L1 from the second detector 175 to the first detector 171 as shown in FIG. 5. Thus, the detection time of the first detector 171 may be longer than the detection time of the second detector 175, and the detection result of the defect from the surface of the transfer belts 151 and 251 may be directly reflected in forming the ACR pattern.

The controller 180 adjusts an ACR error based on data on the defect of the surface of the transfer belts 151 and 251 detected by the first detector 171, and data on the ACR pattern detected by the second detector 175. That is, the controller 180 may cause the data on the ACR pattern formed on the defective location not to be reflected in the adjustment of the ACR error, based on the defective location information of the transfer belts 151 and 251 detected by the first detector 171. Accordingly, the data on the defect of the surface of the transfer belts 151 and 251 may be prevented from being reflected in an ACR algorithm.

The controller 180 may adjust in advance the ACR error based on the data on the ACR pattern formed on the defective location of the transfer belts 151 and 251 detected by the first detector 171, and then reflect the result to a final adjustment of the ACR error. That is, if the defect data on the defect of the surface of the transfer belts 151 and 251 is transmitted by the first detector 171 before the performance of the ACR adjustment algorithm by using the data on the ACR pattern detected by the second detector 175, the controller 180 performs a primary adjustment algorithm in consideration of the defect data and then reflects the ACR pattern data to complete the ACR adjustment.

If the defect from the predetermined location of the transfer belts 151 and 251 is detected by the first detector 171, the controller 180 may control the developing unit 130 to form an ACR pattern by avoiding the defective location.

An auto color registration (ACR) method of the image forming apparatus according to the first and second exemplary embodiments will be described in detail with reference to drawings.

Figure 6:
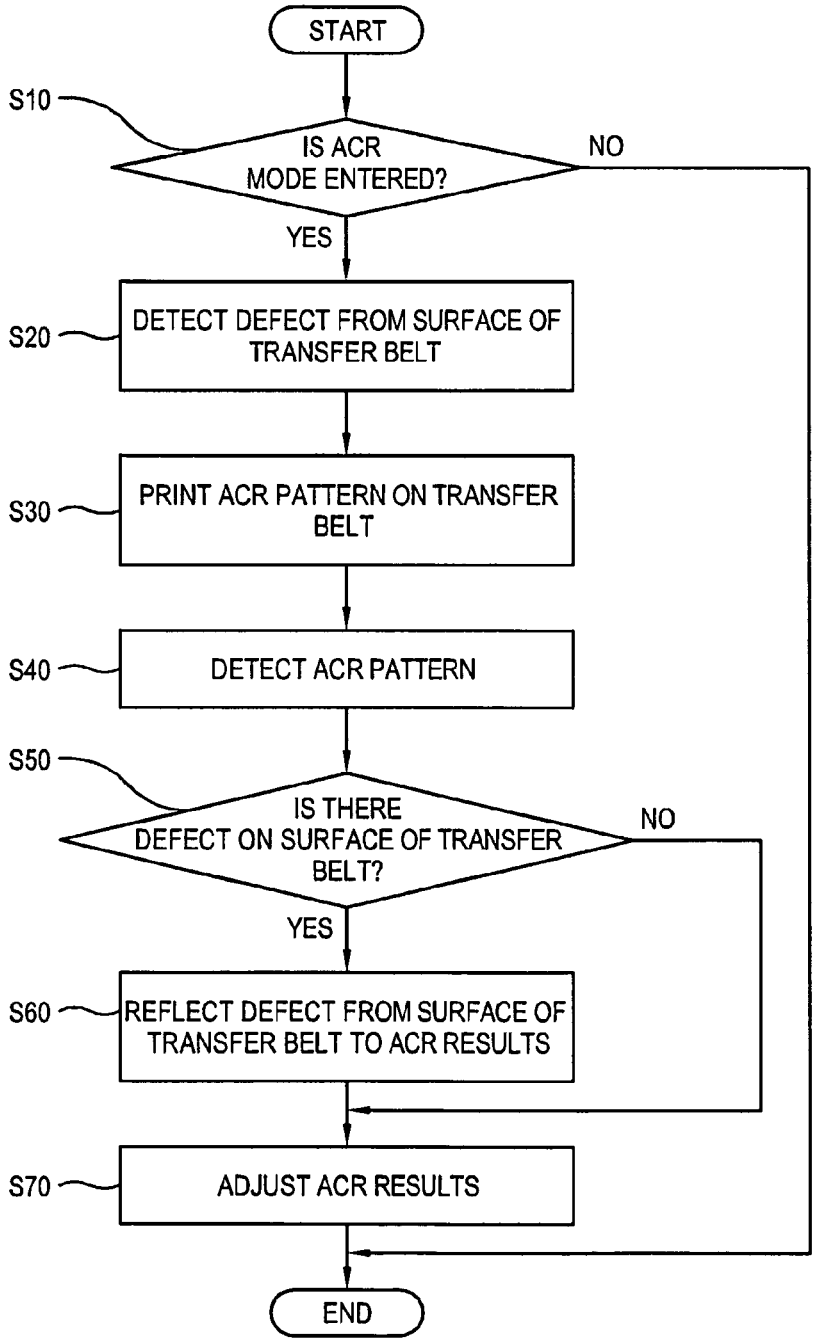
FIG. 6 is a flowchart of an auto color registration method of the image forming apparatus according to the first exemplary embodiment.

FIG. 6 is a flowchart of an ACR method of the image forming apparatus according to the first exemplary embodiment.

Referring to FIGS. 2 to 6, in the ACR method of the image forming apparatus, it is determined whether the image forming apparatus enters an ACR mode (S10). That is, the ACR mode is entered when the ACR performance conditions set for the image forming apparatus are met or when it is determined that there is a problem in an ACR by a user.

When the ACR mode is entered, the first detector 171 detects any defect from the surface of the transfer belts 151 and 251 on which the ACR pattern is not formed (S20). The ACR pattern is then printed on the transfer belts 151 and 251 by the developing units 130 and the image carriers 120 (S30), and the second detector 175 detects the ACR pattern formed on the transfer belts 151 and 251 (S40).

Then, whether there is any defect from the surface of the transfer belts 151 and 251 is determined (S50), and then ACR error result is adjusted in consideration of the foregoing determination. That is, if there is any defect from the surface, such defect is reflected in the ACR results, and the final adjustment of the ACR result is performed (S70). If there is no defect from the surface, the final adjustment of the ACR result is performed without the performance of operation S60.

At operation S60, the defective location information of the transfer belts 151 and 251 detected by the first detector 171 may be used to reflect the data on the ACR pattern formed in the defective location, in the adjustment of the ACR error, or adjust the data on the ACR pattern formed in the defective location to reflect the adjustment to the final adjustment of the ACR error.

Figure 7:
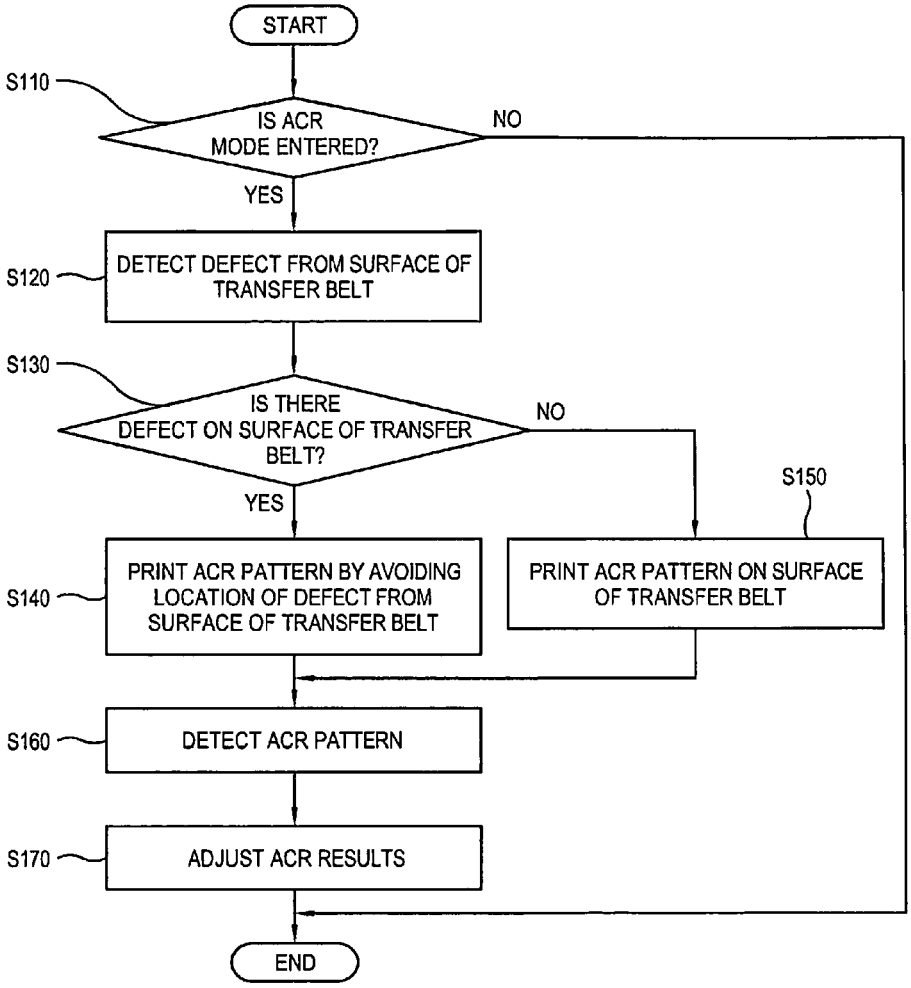
FIG. 7 is a flowchart of an auto color registration method of the image forming apparatus according to the second exemplary embodiment.

FIG. 7 is a flowchart of an ACR method of the image forming apparatus according to the second exemplary embodiment.

Referring to FIGS. 2 to 5 and 7, in the ACR method of the image forming apparatus, it is determined whether the image forming apparatus enters the ACR mode (S110). In the ACR mode, the first detector 171 detects any defect from the surface of the transfer belts 151 and 251 on which the ACR pattern is not formed (S120).

Then, whether there is any defect from the surface of the transfer belts 151 and 251 is determined (S130). If there is no defect from the surface of the transfer belts 151 and 251, the ACR pattern is formed in the predetermined location of the transfer belts 151 and 251 (S150). If it is determined that there is a defect from the surface of the transfer belts 151 and 251 at operation S130, the ACR pattern is printed on the transfer belts 151 and 251 by avoiding the defective location of the surface of the transfer belts 151 and 251.

Then, the second detector 175 detects the ACR pattern formed on the transfer belts 151 and 251 (S160), and the ACR result is adjusted on the basis of the detected data (S170).

The image forming apparatus according to the exemplary embodiments includes the first detector 171 to detect the defect from the surface of the transfer belts 151 and 251, in addition to the second detector 175 detecting the ACR pattern, to thereby reflect the detection result of the defect from the surface of the transfer belts to the ACR adjustment without idling the transfer belts unlike in a conventional image forming apparatus. Thus, the image forming apparatus according to the exemplary embodiments fundamentally prevents issues such as turn-over of the cleaning blade due to the transfer belt at idle, and prevent any increase in the ACR time due to the idle.

As described above, an image forming apparatus and an auto color registration method of the same according to the exemplary embodiments includes a first detector to detecting a defect from a surface of a transfer belt, in addition to a second detector detecting an ACR pattern, to thereby reflect a detection result of the defect from the surface of the transfer belt to the ACR adjustment without idling the transfer belt, fundamentally prevent problems such as turn-over of a cleaning blade due to the idling transfer belt, and prevent increase in ACR time due to the idle.

Although a few exemplary embodiments have been shown and described, it will be appreciated by those skilled in the art that changes may be made in these exemplary embodiments without departing from the principles and spirit of the invention, the range of which is defined in the appended claims and their equivalents.

What is claimed is:

1. An image forming apparatus which forms a color image on a print medium by overlapping an image formed in each color, the image forming apparatus comprising:

a plurality of developing units which each developing unit develops a color image in a predetermined color;

a transfer unit which transfers the color image developed by the plurality of developing units to the print medium and comprises a transfer belt rotatably installed on a transfer path;

a first detector which is provided in a predetermined location of the transfer belt to face the transfer belt and detects any defect from a surface of the transfer belt;

a second detector which is provided in a predetermined location of the transfer belt to face the transfer belt and detects a test pattern of an auto color registration (ACR) error transferred to the transfer belt; and a controller, wherein, if there is a defect from the surface of the transfer belt, the controller is configured to adjust data on the test pattern of the ACR error formed in a defective location of the transfer belt detected by the first detector by using the defective location information, and if there is no defect from the surface of the transfer belt, the controller is configured to cause the data on the test pattern of the ACR error to not be adjusted according to a detection result of the first detector which detects no defect from the surface of the transfer belt.

2. The image forming apparatus according to claim 1, wherein the transfer unit further comprises a cleaning blade which is installed to face the transfer belt and cleans a developer remaining in the surface of the transfer belt.

3. The image forming apparatus according to claim 2, wherein the first detector is arranged in a predetermined location between the cleaning blade and the plurality of developing units to face the transfer belt, and the second detector is arranged in a predetermined location between the plurality of developing units and the cleaning blade to face the transfer belt, based on a rotation direction of the transfer belt.

4. The image forming apparatus according to claim 3, wherein a length from the first detector to the second detector of the transfer belt is longer than a length from the second detector to the first detector of the transfer belt, based on the rotation direction of the transfer belt.

5. An auto color registration (ACR) method of an image forming apparatus which forms a color image on a print medium by overlapping an image formed in each color, the ACR method comprising:

detecting a defect from a surface of a transfer belt by a first detector;

printing a test pattern of an ACR error on the transfer belt;

detecting the test pattern of the ACR error formed on the transfer belt by a second detector;

determining whether there is any defect from the surface of the transfer belt; and if there is a defect from the surface of the transfer belt, adjusting data on the test pattern of the ACR error formed on a defective location of the transfer belt detected by the first detector by using the defective location information; and if there is no defect from the surface of the transfer belt, controlling to cause the data on the test pattern of the ACR error to not be adjusted according to the determining that there is no defect from the surface of the transfer belt based on the detecting by the first detector.

6. The ACR method according to claim 5, wherein the image forming apparatus further comprises a cleaning blade to clean a developer remaining on the surface of the transfer belt, and the first detector is arranged in a predetermined location between the cleaning blade and a plurality of developing units to face the transfer belt, and the second detector is arranged in a predetermined location between the plurality of developing units and the cleaning blade to face the transfer belt, based on a rotation direction of the transfer belt.

7. The ACR method according to claim 6, wherein a length from the first detector to the second detector of the transfer belt is longer than a length from the second detector to the first detector of the transfer belt, based on the rotation direction of the transfer belt.

* * * * *